US011473513B1

(12) United States Patent
Yuan

(10) Patent No.: US 11,473,513 B1
(45) Date of Patent: Oct. 18, 2022

(54) TORQUE CONTROL OF PISTON ENGINE WITH CRANKPIN OFFSET

(71) Applicant: Defang Yuan, Ottawa (CA)

(72) Inventor: Defang Yuan, Ottawa (CA)

( * ) Notice: Subject to any disclaimer, the term of this patent is extended or adjusted under 35 U.S.C. 154(b) by 0 days.

(21) Appl. No.: 17/500,682

(22) Filed: Oct. 13, 2021

(51) Int. Cl.

| | |
|---|---|
| ***F02B 75/28*** | (2006.01) |
| ***F02B 75/32*** | (2006.01) |
| ***F02D 35/02*** | (2006.01) |
| ***F02D 41/30*** | (2006.01) |
| ***F02D 41/40*** | (2006.01) |

(52) U.S. Cl.
CPC ..... *F02D 35/027* (2013.01); *F02B 75/28* (2013.01); *F02B 75/32* (2013.01); *F02D 35/028* (2013.01); *F02D 41/3041* (2013.01); *F02D 41/401* (2013.01); *F02D 2200/025* (2013.01); *F02D 2200/0618* (2013.01); *F02D 2200/101* (2013.01); *F02D 2200/1015* (2013.01)

(58) Field of Classification Search
CPC ..... F02B 75/28; F02B 75/32; F02D 41/401
USPC ..... 123/51 AA, 51 BA, 51 BB
See application file for complete search history.

(56) References Cited

U.S. PATENT DOCUMENTS

| | | | | |
|---|---|---|---|---|
| 11,131,255 | B1 * | 9/2021 | Yuan | F02B 75/28 |
| 11,136,916 | B1 * | 10/2021 | Zhao | F02D 41/0007 |
| 2010/0154749 | A1 * | 6/2010 | Barberato | F02B 75/32 123/48 C |
| 2020/0208522 | A1 * | 7/2020 | Giger | F01B 7/02 |

* cited by examiner

*Primary Examiner* — Erick R Solis

(57) ABSTRACT

A piston engine is provided; the piston engine has a cylinder, a main piston and an auxiliary piston; a combustion chamber is formed between the main piston and the auxiliary piston within the cylinder; the main piston has an crankpin offset L0, the auxiliary piston and the main piston move in different frequencies, an extended constant V≈Vc of the combustion chamber is formed from θ to >10° CA; when at a=θ=arc sin[L0/(L+R)] the main piston is at its top dead center; at a=arc sin(L0/R) the side force on the main piston is 0; when peak pressure of combustion is located at PPmax by choosing ignition timing, the most effective torque can be obtained; the torque is controlled by the amount of fuel injected; engine knocking can be prevented by retarded ignition at a>θ.

20 Claims, 6 Drawing Sheets

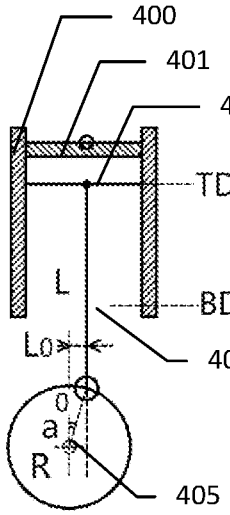

Fig.4A

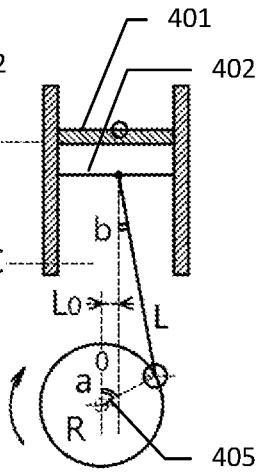

Fig.4B

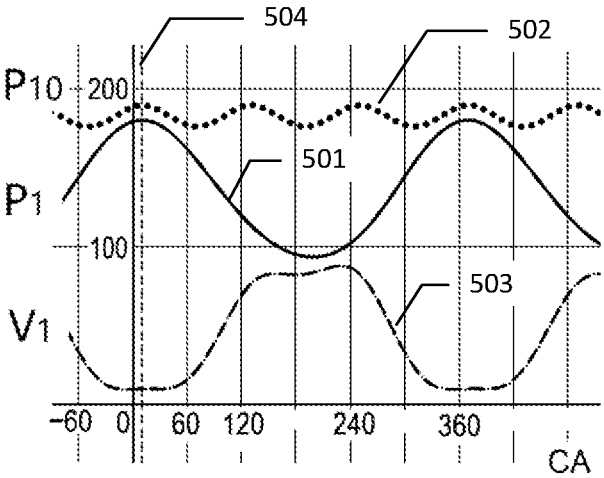

Fig.5

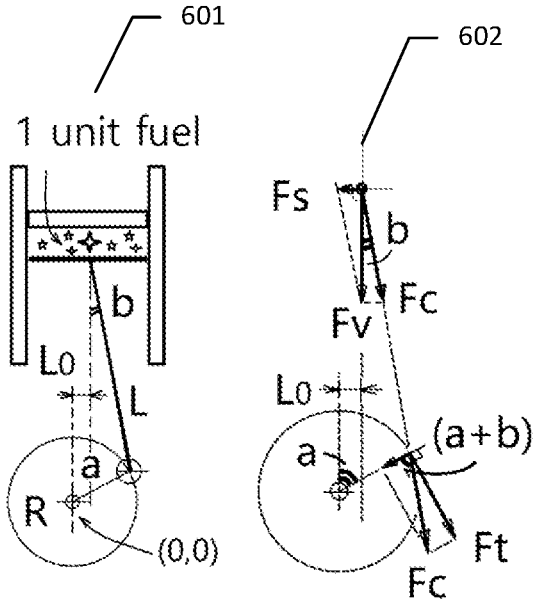

Fig.6

Main Piston

1) $b_1 = \sin^{-1}\left(\frac{R}{L} \cdot \sin a - \frac{L_0}{L}\right)$

2) $P_1 = R\cos a + L\cos b_1$

3) $V_1 = -P_1 + P_{10}$

4) $T_1 \propto \frac{\sin(a+b_1)}{\cos(b_1)} \cdot \left(\frac{1}{V_1}\right)$

5) $Fs_1 \propto \frac{\sin b_1}{\cos b_1} \cdot \left(\frac{1}{V_1}\right)$

6) $\theta = \sin^{-1}\left(\frac{L_0}{L+R}\right)$

Auxiliary Piston

7) $a_{10} = k \cdot (a - \theta) + 180^\circ$

8) $b_{10} = \sin^{-1}\left(\frac{r_1}{l_1} \cdot \sin a_{10}\right)$

9) $P_{10} = D - (r_1 \cos a_{10} + l_1 \cos b_{10})$

Fig. 7

TORQUE CONTROL OF PISTON ENGINE WITH CRANKPIN OFFSET

FIELD OF THE INVENTION

The present disclosure relates to piston engines or reciprocating engines with an offset in crankpin to reduce side force on cylinder wall, and an additional (auxiliary) piston is added to constrain the combustion chamber volume. The novel piston engine has a widened constant combustion volume clearance Vc near its top dead center, so that peak combustions can be made at a larger crank angle to boost the output torque on crankshaft, and the engine fuel efficiency is significantly improved.

BACKGROUND OF THE INVENTION

In Toyota piston engine families, most of the models have an offset in crankpin; that is, the central line of the connecting rod is not aligned with the center of its crankshaft when it is vertical but has an offset L0, such as 12 mm in 1997 model 1NZ, 8 mm in 2007 model 3ZR, 10 mm in 2017 and 2018 models A25 and M20. This configuration reduces the side force on cylinder wall and piston at peak combustion pressure but someway compromises the output torque on crankshaft. FIG. 1 is an illustration of Toyota engines, wherein the crankpin has an offset L0, when crank angle is a=16.529°, the connecting rod is vertical, and is not aligned with the center of the crankshaft. FIG. 2 shows that the side force Fs on piston is shifted downwards in referring to an engine without an offset, wherein Fs is reduced near 50% at near 30° CA but output torque T is reduced before 30° CA; the reduction of T is near 11% at a=20° CA. In FIG. 2, the solid lines are of engine with L0=0, dotted lines are of engine L0=12 mm as in 1NZ model.

In U.S. patent Ser. Nos. 11/131,255 and 11/136,916, a second piston (auxiliary piston) is introduced to constrain the combustion chamber in each configuration to extend the clearance volume Vc, the fuel efficiency is improved by moving peak combustion to larger crank angles. FIG. 3A shows that the crankpin has no offset (L0=0); when crank angle a=0° CA, the center line of the connecting rod of the main piston is vertical and aligned with the center of the crankshaft. In order to reduce the side force of the main piston, an offset in crankpin is preferred especially in engine with auxiliary piston. The algorithm(s) in U.S. patent Ser. Nos. 11/131,255 and 11/136,916 are no longer the optimized ones when crankpin offset L0 is configured.

Therefore, there remains a need for an novel piston engine, which has an offset in crankpin and is optimized in algorithm(s) in the auxiliary piston motion and position, to reduce the side force and increase output torque on crankshaft at same time.

SUMMARY OF THE INVENTION

The present invention uses an auxiliary piston to constrain the combustion chamber:

a cylinder defining an interior space therein, the cylinder encloses a chamber therein, a main piston configured to fit sealingly inside the cylinder and move up and down along the centerline of the cylinder therewithin; an auxiliary piston is configured to fit inside the cylinder and move up and down along the centerline of the cylinder, the main piston is connected to a first connecting rod, the first connecting rod is connected to a first crankshaft;

the auxiliary piston is connected to a second connecting rod, the second connecting rod is connected a second crankshaft; wherein the length l of the second connecting rod is shorter than the length L of the first connecting rod; the radius r of the second crankshaft is smaller than the radius R of the first crankshaft, the motion of the auxiliary piston relates to the rotational motion of the first crankshaft, wherein at any position of the first crankshaft, the auxiliary piston is at a corresponding position; wherein the main piston and the auxiliary piston move at different frequencies, wherein when the centerline of the first connecting rod is at its vertical position, the centerline of the first connecting rod has an offset L0 to the center of the first crankshaft; the offset L0 is bigger than R*10%, wherein a is crank angle of the first crankshaft, wherein the main piston reaches its top dead center at a=0=arc sin[L0/(L+R)], wherein the side force on the main piston is zero (0) at a=arc sin(L0/R), the enclosed space within the cylinder and between the main piston and the auxiliary piston defines a combustion chamber with volume V, wherein when the first crankshaft is at a=0 position, the auxiliary piston is at a position which constrains the combustion chamber V to its minimum and to equal to Vc, wherein Vc is defined as a clearance volume, the motions of the main piston and the auxiliary piston further constrain the combustion chamber volume V≈Vc from a=θ to a>15° (CA) in referring to the crank angle of the first crankshaft; or the variation of the Vis within 1% of Vc, or (Vc−Vc*1%)<V<(Vc+Vc*1%) from a=θ to a>15° (CA).

Another embodiment of the present invention is provided:

The auxiliary piston position is controlled by an actuator mechanism to constrain the combustion chamber volume V≈Vc from a=θ to a>10° (CA). The actuator mechanism is a cam, a camshaft or a servo.

A direct torque control method of a piston engine of the present invention is provided:

a cylinder defining an interior space therein, the cylinder encloses a chamber therein, a main piston configured to fit sealingly inside the cylinder and move up and down along the centerline of the cylinder therewithin; an auxiliary piston is configured to fit inside the cylinder and move up and down along the centerline of the cylinder, wherein the main piston is connected is a main crankshaft via a main connecting rod, wherein angle a is defined as the crank angle of the main crankshaft, angle b is defined as the angle of the centerline of the main connecting rod, the main piston and the auxiliary piston move at different frequencies, the enclosed space within the cylinder and between the main piston and the auxiliary piston defines a combustion chamber with volume V, wherein when the centerline of the main connecting rod is at its vertical position, the centerline of the main connecting rod has an offset L0 to the center of the main crankshaft; θ=arc sin[L0/(L+R)] and L0 is bigger than R*10%, wherein when the main piston is at its top dead center at a=θ, wherein the side force on the main piston is zero (0) at a=arc sin(L0/R), wherein when the main crankshaft is at a=θ position, the auxiliary piston is at a position which constrains the combustion chamber V to its minimum and to equal to Vc, wherein Vc is defined as a clearance volume, the motions of the main piston and the auxiliary piston further constrain the combustion chamber volume V≈Vc from a=θ to a>10° (CA) in referring to the crank angle of the main crankshaft; or the variation of the Vis within 1% of Vc, or (Vc−Vc*1%)<V<(Vc+Vc*1%) from a=θ to a>10° (CA), wherein PPmax is the crankshaft angle a when expression [(1/V)*sin(a+b)/cos(b)] makes its maximum value in the range from θ to 90° (CA), wherein from 100 RPM to 1000 RPM of the main crankshaft, all peaks of combustion pressure are located at PPmax position; wherein ignition starts after θ.

Other features and advantages of the present invention will become apparent from the following detailed description and the accompanying drawings, which illustrate, by way of example, the principles of the invention.

BRIEF DESCRIPTION OF THE DRAWINGS

By way of example only, preferred embodiments of the present invention are described hereinafter with reference to the accompanying drawings, wherein:

FIG. 4A is an illustration of one of the embodiments of the present invention with offset;

FIG. 4B is an illustration of one of the embodiments of the present invention with offset;

FIG. 5 is an illustration of piston positions and combustion volume of one of the embodiments of the present invention;

FIG. 6 is an illustration of acting forces of one of the embodiments of the present invention;

FIG. 7 is some of the mathematic expressions of multiple parameters used in the embodiments of the present invention;

DETAILED DESCRIPTION OF THE INVENTION

Figure 1:
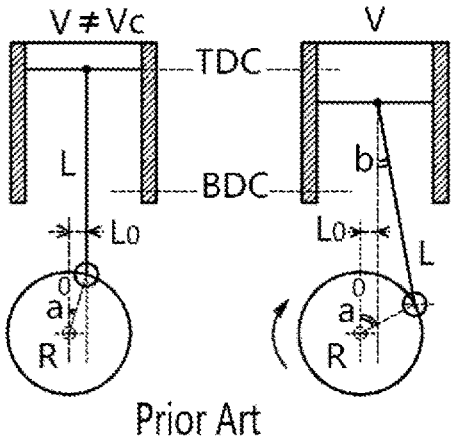
FIG. 1 is an illustration of one prior art piston engine model with crankpin offset.

It is to be understood that the disclosure is not limited in its application to the details of the embodiments as set forth in the following description. The invention is capable of other embodiments and of being practiced or of being carried out in various ways.

Furthermore, it is to be understood that the terminology used herein is for the purpose of description and should not be regarded as limiting. Contrary to the use of the term "consisting", the use of the terms "including", "containing", "comprising", or "having" and variations thereof is meant to encompass the items listed thereafter and equivalents thereof as well as additional items. The use of the term "a" or "an" is meant to encompass "one or more". Any numerical range recited herein is intended to include all values from the lower value to the upper value of that range.

Graphics are used in order to simplify the description which involves curves and transcendental functions, most of the parameters in the graph such as force, torque, piston bore area and volumes are scaled for ease of understanding, or are normalized to 1.00 or 100% at given conditions, and are basically showing a mutual contrast relationship instead of the actual values. The crank angle a in ° CA in the graph is the actual value in referring to the main crankshaft.

In the description, the torque loss due to the combustion leading to the piston TDC is not included, nor are motoring stroke losses and the friction losses. It is further assumed that the time from start of ignition to the maximum combustion pressure PPP is constant, without taking consideration of the influence of cylinder temperatures, pressures etc.

The directions and positions used in the description, such as up, down, vertically, horizontally, left and right, are based on the directions and relative positions shown in the Figures, and are not necessarily the directions and positions in actual real-life applications. The term position used in the description may refer to the physical position or the crank angle position. The abscissa (x-axis) of the variable in CA is identified by the crank angle of main crankshaft. Crank angle a=0 CA is defined at the angle when the center of the big end of the main connecting rod is at the upmost position of the main crankshaft (or at the very top position of the main crankshaft). The main crankshaft center is defined as zero reference position (0,0). The terms rotation and/or revolution RPM (or rpm) are also used to describe angular motion or angular position.

List of Symbols:

V combustion chamber volume
Vc clearance volume of combustion chamber V
a crank angle in degrees of main crankshaft, or shortly as ° CA
b angle between vertical centerline of cylinder and connecting rod
Fs side force applied on piston
Fv vertical force on piston
Fc force on connecting rod
Ft tangential force on crankshaft
T torque on main crankshaft
PPP peak pressure position in crank angle CA
PPmax the position with maximum tangential force
R radius of (main) crankshaft
L (main) connecting rod length
L0 offset of crankpin
TDC top dead center of piston
BDC bottom dead center of piston
Θ θ or Θ, phase delay or phase shift
r radius of auxiliary piston crankshaft
connecting rod length of auxiliary piston
n speed of the main crankshaft, in RPM or DPmS Some symbols or values are sometimes made in italics or bolds for easy reading, they have the same meaning as in the List of Symbols above.

In the description of the combustion chamber volume (V) and its constant area Vc (plateau or flattened or extended Vc), the range regarding its crank angle position (x-axis) is expressed as a=x1° CA to a=x2° CA. The range regarding its volume (y-axis) is expressed as mm (millimeters) or just unit-less numbers in given piston (for example, where L=140.85, R=42.18, and bore area is normalized as 1.00 unit). Piston positions are described in mm or unit-less numbers in referring to the zero position (0,0) of the center point of the main crankshaft. Engine part sizes used in description are basically from Toyota 1NZ, wherein connecting rod length is L=140.85 mm, radius of crankshaft R=42.18 mm, clearance volume Vc=8.916, wherein strokes vary at different crankpin offsets (stroke=84.7 mm at offset L0=12 mm) and clearance volume Vc=8.916. It is to be noticed that relations between crank angle a=° CA and TDC or BDC of the main piston vary at different L0, while in U.S. patent Ser. Nos. 11/131,255 and 11/136,916 crank angle a=° CA and TDC has fixed relations.

FIG. 1 is an illustration of Toyota 1NZ model, which has an offset L0=12 mm, the clearance volume (Vc=8.916) does not appear at a=0° CA but at a=0, and TDC is not at a=0° CA but at a=0, where 0=3.759° CA.

Figure 2:
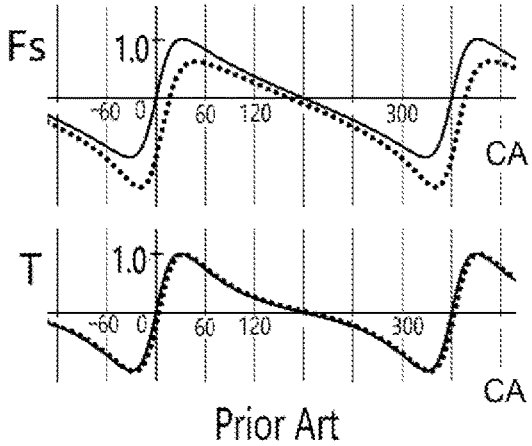
FIG. 2 is an illustration of side force (Fs) and Torque (T) in Toyota 1NZ model.

FIG. 2 is an illustration of normalized side forces Fs and crankshaft torques T of two engines having the same connecting rod size and crankshaft size as in 1NZ. Wherein the solid lines are of L0=0 (no offset), and dotted lines are L0=12 mm (offset=12 mm). FIG. 2 shows Fs is shifted downwards, that means side force Fs is decreased at combustion stroke but increased in compression stroke at same given fuel combusted; and torque T is reduced before 30° CA at same given fuel combusted, detailed calculations are described latterly.

Fs and T are instantaneous values in FIG. 2, and are calculated at the conditions where bore area=1.00 and 1 unit fuel is 100% combusted at each crank angle CA, where L=140.85, R=42.18, Vc=8.916. These conditions are applied to FIG. 2 and to all T and Fs in following calculations.

Figure 3A:
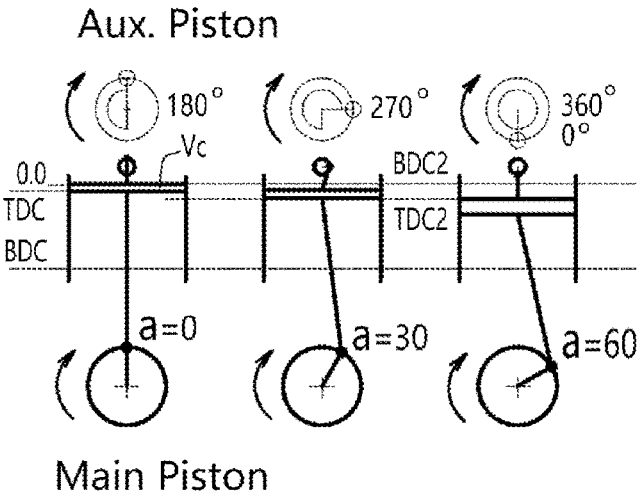
FIG. 3A is an illustration of U.S. patent Ser. No. 11/131,255 and 11136916, wherein offset is zero.

FIG. 3A is a configuration with auxiliary piston in U.S. patent Ser. Nos. 11/131,255 and 11/136,916, wherein the constant combustion chamber Vc extends from 0° to a>30° CA; that means the side force Fs is much greater than that of engine in FIG. 1 at same cylinder pressure at a=30° CA. And a crankpin offset is preferred to reduce side force in this situation.

Figure 3B:
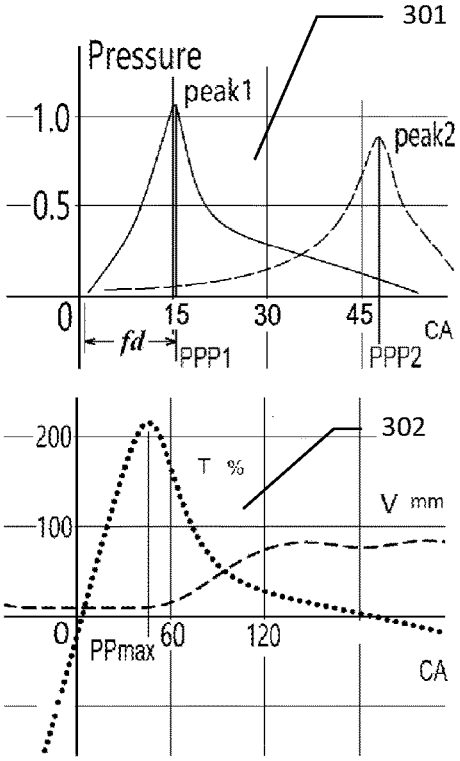
FIG. 3B is an illustration of peak pressure position PPP and PPmax position.

FIG. 3B is explanations of PPP and PPmax.

Each combustion starts from ignition and reaches to its peak cylinder pressure at PPP position; the moment of start of ignition and cylinder conditions may differ, so each combustion has its own individual PPP even if the fuel combusted is same. PPP is defined by crank angle CA at peak cylinder pressure. Different PPP curves are shown in 301.

PPmax is the crank angle position where 1 unit of cylinder pressure can make maximum torque (or maximum tangential force) on crankshaft. PPmax is determined by the combustion chamber profile (the shape or projector of combustion chamber, or its geometry sizes); PPmax is the characteristic of the piston and combustion chamber; PPmax is independent of fuel or ignition. Curve 302 shows the relations of torque T and combustion chamber volume V, where the maximum torque appears at PPmax position. When PPP is located at PPmax, or PPP is coincided with PPmax, maximum torque and best fuel efficiency are achieved. Wherein mathematically PPmax is the crankshaft angle a when expression [(1/V)*sin(a+b)/cos(b)] makes its maximum value in the range from θ to 90° (CA), this is further expressed as formula 4 in FIG. 7.

Wherein fd in 301 of FIG. 3B is the time interval from the moment of a ignition starts to the moment of peak pressure appears; herein fd is expressed in milliseconds (ms, or 1/1000 second). The control logic of present invention is to choose right ignition timing to make every peak combustion exactly at PPmax. Being benefited from its unique combustion chamber (for example, the constant Vc extends to 30° CA), the engine in the present invention can achieve best fuel efficiency or maximum torque at per unit of fuel from 100 rpm to 2000 rpm. This has never been done in prior art engines.

FIG. 4A is one of the embodiments of the present invention with offset L0, when the connecting rode 403 is vertical, the crankpin with has an offset L0 to crankshaft center 405, and an auxiliary piston 401 is used to extend the constant combustion volume Vc, the auxiliary piston 401 and the main piston 402 are moving in cylinder 400. And 405 is defined as the reference zero position (0, 0), R is the radius of the main crankshaft; L is the length of the connecting rod 403. Cylinder 400 can be a single piece cylinder or a cylinder combined by an upper piece and a lower piece. Piston 401 and 402 move in cylinder 400 along the vertical centerline of the cylinder 400.

FIG. 4B is a further explanation of FIG. 4A. When the connecting rod is not in vertical position, the crankpin offset is L0. And then auxiliary piston is 401, the main piston is 402, the connecting rod angle is b, the center of crankshaft 405 is the reference zero position; and a is the crank angle of the main crankshaft, R is the radius of the main crankshaft, L is the length of the connecting rod 403. Comparing the engine in FIG. 4A and FIG. 4B, it is to be noticed that the crank angle in FIG. 4B is greater than that in FIG. 4A but two combustion chamber volumes are almost the same, this means that the Vc is extended to a larger crank angle. This is the key innovation of present invention.

FIG. 5 shows one of the embodiment of the present invention with an auxiliary piston, wherein the auxiliary piston position is 502 (curve P10); the main piston position is 501 (curve P1); the combustion chamber volume is 503 (curve V1); wherein the top dead center of the main piston is shifted to 504, and the combustion chamber volume is flattened and extended (or nearly constant in Vc, or V1≈Vc) from 0° CA to 30° CA. It can be seen that the combustion chamber is not symmetrical in referring to the top dead center and/or the bottom dead center of the main piston. The following calculations show that the output torque is significantly increased at same fuel combusted because the extended Vc of this configuration.

FIG. 6 is illustrations of the relations of multiple forces of the engine in FIGS. 4A and 4B. Where 601 shows 1 unit of fuel combusted completely in the combustion chamber at crank angle a=a and the connecting rod angle is b. And 602 shows the angles and the force vectors on the main piston: combustion vertical force (vertical force Fv), cylinder wall force (side force Fs), connecting rod force (force Fc) and the torque force on main crankshaft (tangential force Ft).

To make the expression simple, some conditions are pre-set as:

a), The bore area (or main piston area) is normalized as 1.00, Fv is defined as the vertical force on the main piston when 1 unit of fuel combusted completely in combustion chamber with volume V. The friction force caused by side force Fs is not taken into consideration.

b), The vertical force Fv is inversely proportional to the combustion chamber volume V under the condition of 1 unit of fuel combusted, or Fv=1/V when normalized. The force Fc on connecting rod is Fc=Fv/cos(b); the side force Fs=Fc*sin(b); the torque force or tangential force on crankshaft is Ft=Fc*sin(a+b)=Fv*sin(a+b)/cos(b), the torque on crankshaft is then T=Ft*R=Fv*R*sin(a+b)/cos(b)=(1/V)*R*sin(a+b)/cos(b), and T is further simplified as T=(1/V)*sin(a+b)/cos(b) after being moralized by R as in Formula 4 of FIG. 7.

FIG. 7 shows some the mathematic relations of the parameters of one of the embodiments of the present invention in FIG. 4B or FIG. 6. Wherein a, b1, P1, V1, T1, Fs1, R, L and L0 are use to describe the main piston, the subscripts in formula 1 to 6 can be null or replaced by different numbers in each individual example to describe related main piston. Wherein a10, b10, P10, r1, l1 and D are use to describe the auxiliary piston, D is a position adjustment (a constant factor) used to make the clearance volume V1=Vc=8,916 at a=θ. the subscripts in formula 7 8 and 9 can be null or replaced by different numbers in each individual example to describe related auxiliary piston. Wherein k is integers 2, 3, 4, 5, 6 etc., and θ is the crank angle of the top dead center position of the main piston, wherein θ=arc sin[L0/(L+R)]. Vc=8.916 (mm) is the clearance volume in the examples unless otherwise specified.

Figure 8:
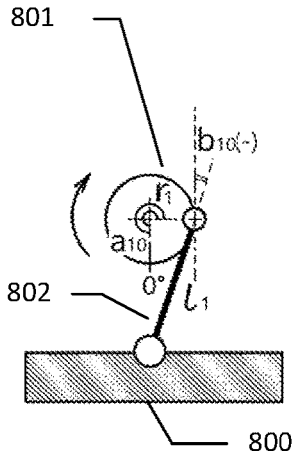
FIG. 8 is an illustration of an auxiliary piston controlled by a crankshaft in one of the embodiments of the present invention.

FIG. 8 is one of the embodiment of auxiliary piston 800, its crankshaft is 801 and connecting rod is 802, in the present invention. And a10, b10, 11 and r1 are its crank angle, connecting rod angle/length and crankshaft radius respectively; these are also as shown in formulas/expressions in FIG. 7.

Figure 9:
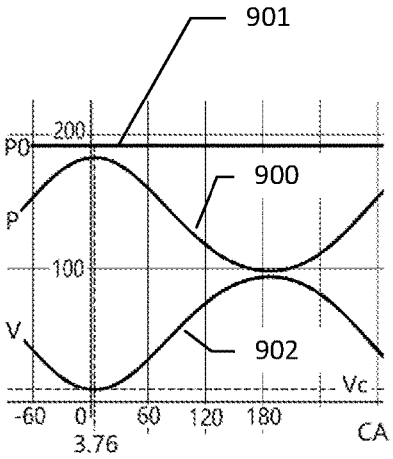
FIG. 9 is an illustration of P0, P and V vs crank angle CA in Toyota model 1NZ.

FIG. 9 is of engine 1NZ, the piston position P (curve 900) and combustion chamber volume V (curve 902) in Toyota 1NZ, where the cylinder head is in fixed position and its position P0 is a straight line 901. In 1NZ model, bore size=1 unit, R=42.18, L=140.85, Vc=8.916, compression ratio is 10.5:1, stroke is 84.7, top dead center is at 0=3.759°, the zero side force Fs is at a=16.529° CA. The 1NZ model can be expressed using formulas in FIG. 7. These basic parameters are used in the embodiments of the present invention are listed in the description.

Examples of the present invention.

Example A: by adding an auxiliary piston to constrain the combustion chamber volume based on the piston engine in Toyota 1NZ as shown in FIGS. 4A and 4B. Wherein the main piston is expressed as formulas 1-6 in FIG. 7; the auxiliary piston is l1=L/5.20, r1=R/4.88 and k=3, and expressed as formulas 7-9 in FIG. 7.

Figure 10:
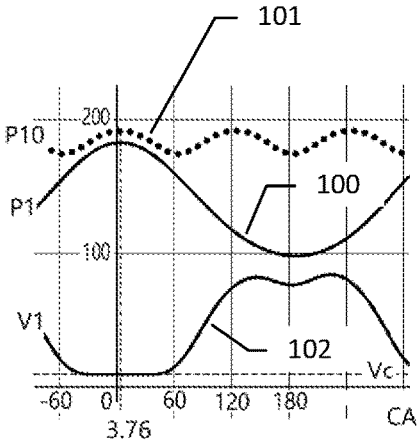
FIG. 10 is an illustration of P10, P1 and V1 vs crank angle CA in one of the embodiments of the present invention k=3.

FIG. 10 shows piston positions and combustion chamber vs crank angle of example A; where the main piston position P1 is curve 100, the auxiliary piston position P10 is curve 101 and the combustion chamber volume V1 is curve 102. The main piston has the same size as 1NZ (as in FIG. 9), L=140.85, R=42.18, clearance volumes=Vc; the engine reaches to its top dead center at 0=3.759° CA; the auxiliary piston l1=L/5.20, r1=R/4.88. And example A can be expressed as formulas in FIG. 7 with k=3.

It can be seen that the main piston positions vs CA are exactly the same in 1NZ and example A (P1 in FIG. 10 and P in FIG. 9). The significant difference is that V reaches Vc at 0=3.759° in 1NZ while V1 keeps V1 constant (V1≈Vc) from θ to >30° CA in example A. The extended V1≈Vc results a much higher torque at near 30° CA.

Figure 11:
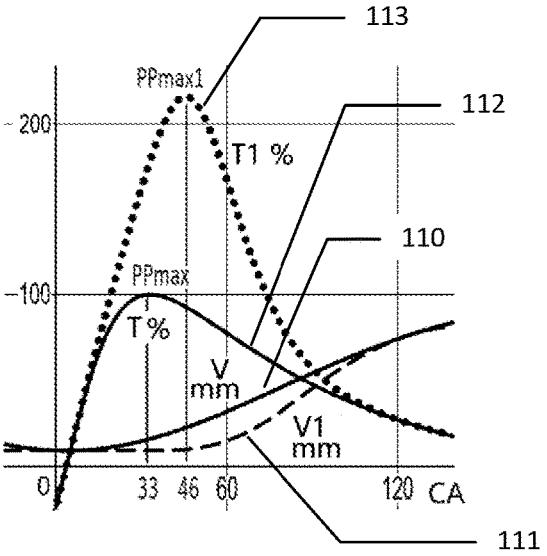
FIG. 11 is an illustration of torques T and combustion volumes V vs crank angle CA of Toyota 1NZ and one of the embodiments of the present invention k=3.

FIG. 11 is a comparison in torques and combustion chambers between example A and 1NZ. For example A, combustion chamber V1 is curve 111 and Torque T1 is curve 113; for 1NZ combustion chamber V is curve 110 and Torque T is curve 112. V1, V, T1 and T are calculated by formulas 1-9. In example A the engine has an auxiliary piston which keeps moving in a way as in formulas 7-9, in 1NZ the engine has a fixed cylinder head which does not move.

The combustion chamber volume reaches V=Vc at a=3.759° in 1NZ, while the combustion chamber volume V1 keeps almost unchanged (V1≈Vc+/−1% Vc) from a=3.759° to a=40° in example A. The max. torque is T=100% at a=33.256° in 1NZ, and the max. torque is T1=216% at a=45.761° in example A. The PPmax position is shifted from PPmax=33.256° CA in 1NZ to PPmax1=45.761° CA in example A.

Figure 12:
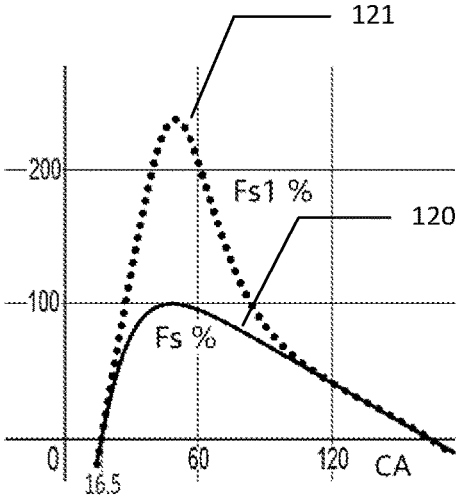
FIG. 12 is an illustration of side forces Fs vs crank angle CA of Toyota 1NZ and one of the embodiments of the present invention k=3.

FIG. 12 is a comparison of side forces Fs between 1NZ and example A. Where the side force is increased from Fs=100% in 1NZ (curve 120) to Fs1=237.74% in example A (curve 121) at their peaks. Both Fs and Fs1 are zero at a=16.529° CA. The side force Fs in curve 120 is changed a lot to Fs1 in curve 121. It is to be mentioned the side force increment is basically the result of combustion pressure increment due to reduced combustion volume near their peaks, it is not necessarily any compromising to its efficiency.

Example B: by increasing the crankpin offset from 12 mm to 24 mm based on example A. Wherein the main piston is expressed as formulas 1-6 in FIG. 7, L0=24 mm; the auxiliary piston is l1=L/6.28, r1=R/4.64 and k=3, and expressed as formulas 7-9 in FIG. 7.

Figure 13:
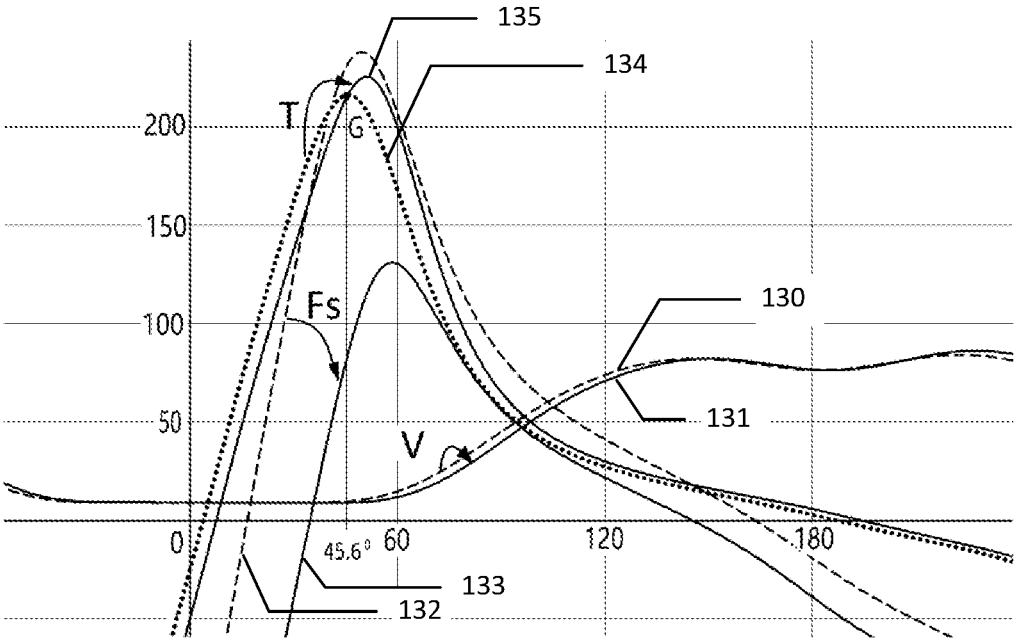
FIG. 13 is an illustration of torques T, side forces Fs and combustion chambers V vs crank angle CA when offset L0=12 mm and 24 mm in one the present invention k=3.

FIG. 13 is a comparison of torques T and side forces Fs between example A and B: Example A is L=140.85, L0=12 (mm), R=42.18, k=3, l1=L/5.20, r1 R/4.88, Vc=8.916; where T (134), Fs (132) and V (130) are shown in dashed and dotted lines. Example B is L=140.85, L0=24 (mm), R=42.18, k=3, l1=L/6.28, r1=R/4.64, Vc=8.916; where T (135) Fs (133) and V (131) are shown in solid lines.

When L0 is increased, the volume V is further extended (flattened) from curve 130 to curve 131, the side force Fs is further shifted downwards from curve 132 to curve 133, and output torque T is further increased from curve 134 to curve 135 at peak. At G position, the torques T are the same, but side force Fs is reduced from 231% to 84%, the reduction is significant.

From the comparison of example B and A, it can be concluded that larger offset of crankpin is still practicable without compromising output torque when an auxiliary piston is introduced; while in contrast, the output torque is further reduced in peak when the offset of crankpin is increased without the constraint of an auxiliary piston as in 1NZ. And the comparisons are also shown in FIG. 2 and in FIG. 13.

Example C: another embodiment of present invention is by changing k; where k=2, L=140.85, L0=12 (mm), R=42.18, Vc=8.916, l1=L/2.25, r1 R/2.31. By comparing 1NZ to example C, as in FIG. 14, where torque T is increased from 100% in 1NZ to 279% in example C, and PPmax is increased from 33.256° CA to 61.68° CA. The torque on the auxiliary crankshaft is increased in example C because the sizes of connecting rod and crankshaft of the auxiliary are bigger than that in example A. Curves in FIG. 14 are calculated using formulas in FIG. 7.

Figure 14:
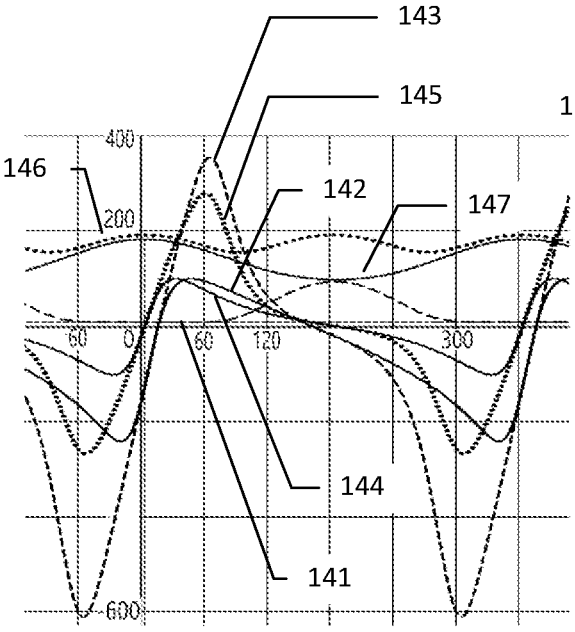
FIG. 14 is an illustration of torques T, side forces Fs and combustion chambers V vs crank angle CA when offset L0=12, k=2 in one of the present invention and 1NZ.

FIG. 14 is the comparison between 1NZ and example C. The combustion chamber volume V of example C is curve 141, it has a plateau after θ. The side force Fs of 1NZ is curve 142, the Fs of example C is curve 143. The torque T of 1NZ is curve 144, the torque T of example C is curve 145. The maximum torque is increased from 100% in 1NZ to 279% in example C.

Wherein curve 146 is the position of the auxiliary piston, the curve 147 is the position of the main piston. The positions of the main pistons are the same both 1NZ and example C.

Example D: another embodiment of present invention by changing k; where k=4, L=140.85, L0=12 (mm), R=42.18, Vc=8.916, l1=L/6.81, r1=R/8.63. Where torque T is increased from 100% in 1NZ to 180% in example D, and PPmax is increased from 33.256° CA in 1NZ to 37.766° CA in example D.

Comparing example D to A, the torque on the auxiliary crankshaft is reduced in example D because the sizes of connecting rod and crankshaft of the auxiliary are smaller than that in example A. Curves in FIG. 15 is calculated using formulas in FIG. 7.

Figure 15:
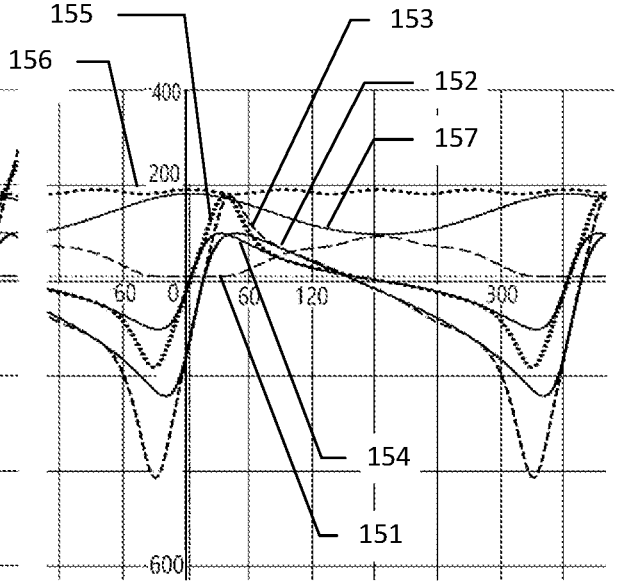
FIG. 15 is an illustration of torques T, side forces Fs and combustion chambers V vs crank angle CA when offset L0=12, k=4 in one of the present invention and 1NZ.

FIG. 15 is a comparison between 1NZ and example D. The combustion chamber volume V of example D is curve 151, it has a plateau near 0. The side force Fs of 1NZ is curve 152, the side force Fs of example D is curve 153. The torque T of 1NZ is curve 154, the T of example D is curve 155. The maximum torque is increased from 100% in 1NZ to 180% in example D.

Wherein curve 156 is the position of the auxiliary piston, the curve 157 is the position of the main piston. The positions of the main pistons are the same both 1NZ and example D.

From example A, B, C and D, It can be seen that more configurations can be achieved with the help of an auxiliary piston to constrain the combustion chamber:

1, different offsets in crankpin are practicable, especially a bigger offset;

2, different frequencies of the auxiliary piston are practicable, such as k=2, 3, 4, 5, 6;

3, the auxiliary piston parameters are determined by specific settings in item 1 and 2 above;

4, different but increased torque curves can be achieved;

5, the basic of the present invention is to control the position/motion of the auxiliary piston to achieve preferred (more specifically, V≈Vc in a wider range) torque patterns or torque curves.

Engine 1NZ and example A to D are summarized in Table 1.

TABLE 1

| | | Offset 12 mm, 24 mm, k = 2, 3, 4, | | | |
|---|---|---|---|---|---|
| Items | Toyota 1NZ | Example C k = 2 | Example A k = 3 | Example D k = 4 | Example B k = 3 |
| a@TDC | 3.759° | 3.759° | 3.759° | 3.759° | 7.535° |
| a@BDC | π + 6.985° | π + 6.985° | π + 6.985° | π + 6.985° | π + 14.078° |
| a@Fs = 0 | 16.529° | 16.529° | 16.529° | 16.529° | 34.68° |
| θ | 3.759° | 3.759° | 3.759° | 3.759° | 7.535° |
| L | 140.85 | 140.85 | 140.85 | 140.85 | 140.85 |
| R | 42.18 | 42.18 | 42.18 | 42.18 | 42.18 |
| L0 | 12 mm | 12 mm | 12 mm | 12 mm | 24 mm |
| l | | L/2.25 | L/5.20 | L/6.81 | L/6.28 |
| r | | R/2.31 | R/4.88 | R/8.63 | R/4.64 |
| PPmax | 33.256° | 61.68° | 45.761° | 37.766° | 51.057° |
| T@PPmax | 100% | 279% | 216% | 180% | 225% |
| k | (k = 0) | K = 2 | K = 3 | K = 4 | K = 3 |
| Vc | 8.916 | 8.916 | 8.916 | 8.916 | 8.916 |
| Plateau | at θ | 0 to >50° | 0 to >40° | 0 to >30° | 0 to >43° |

For the controlling the motion or position of the auxiliary piston, there are more than one ways. The more easy and flexible way is to use a cam/camshaft, a servo motor, etc., as far as the position/motion of the auxiliary piston follows the formulas 7 to 9 in FIG. 7 in an crank angle range from a=θ to a=15° CA or bigger.

When cam or camshaft is used to control the auxiliary piston, the combustion chamber volume profile or trajectory is more flexible, additional benefits can be obtained in different applications. Wherein the main piston follows the formulas 1-6 in FIG. 7, the position/motion of the auxiliary piston or profile of the cam follows the formulas 7-9 in FIG. 7 from a=θ to a>15° CA.

Figure 16A:
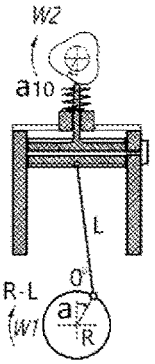
FIG. 16A is an illustration of an auxiliary piston controlled by a cam/camshaft in one of the embodiments of the present invention.

FIG. 16A is one the embodiment of the present invention where the auxiliary piston is controlled by a cam or camshaft, where the rotation speeds are w1 and w2. The position/motion of the auxiliary piston is determined by the profile of the cam/camshaft and its rotation speed w1/w2.

Figure 16B:
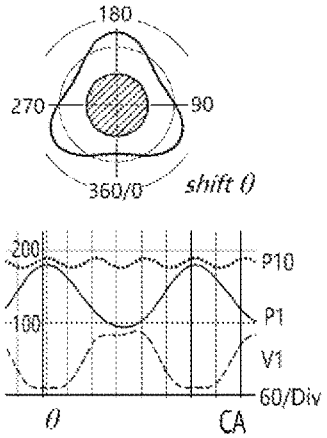
FIG. 16B is an illustration of cam profile, piston positions and combustion volume in one of the embodiments of the present invention.
Figure 16C:
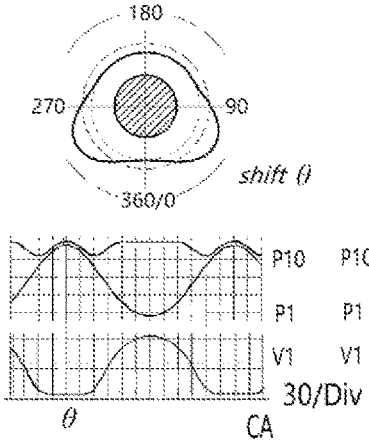
FIG. 16C is another illustration of cam profile, piston positions and combustion volume in one of the embodiments of the present invention.
Figure 16D:
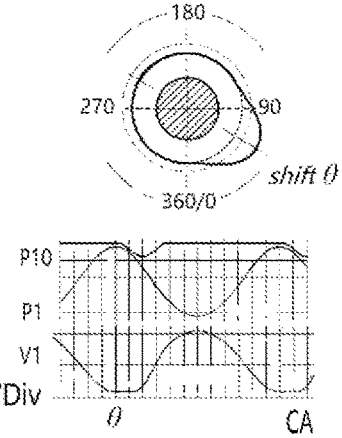
FIG. 16D is another illustration of cam profile, piston positions and combustion volume in one of the embodiments of the present invention.

Some of the profiles of the cams are shown in FIGS. 16B, 16C and 16D. the cams are illustrated without 0 shift. In real applications with a main piston as reference, a phase shift θ must be taken into consideration, as formula 6 and 7 in FIG. 7.

FIG. 16B is a profile of one of the cam/camshaft of the present invention, where the auxiliary piston is controlled by the cam, the rotation speed w1=w2, the auxiliary position is curve P10, the main piston position is curve P1 and the combustion chamber volume is curve V1. The profile of the cam follows the formulas in FIG. 7 from θ−180° to θ+180° CA. And V≈Vc is extended to a>15° CA.

FIG. 16C is another profile of one of the cam/camshaft of the present invention, where the auxiliary piston is controlled by the cam, the rotation speed w1=w2, auxiliary position is curve P10, the main piston position is curve P1 and the combustion chamber volume is curve V1. The profile of the cam follows the formulas in FIG. 7 from θ−120° to θ+120°. And is extended to a>15° CA.

FIG. 16D is a third profile of one of the cam/camshaft of the present invention, where the auxiliary piston is controlled by the cam, the rotation speed w1=w2, auxiliary position is curve P10, the main piston position is curve P1 and the combustion chamber volume is curve V1. The profile of the cam follows the formulas in FIG. 7 from θ to θ+120°. And V≈Vc is extended to a>15° CA.

The phase shifts θ are not shown in FIGS. 16B, 16C and 16D because it is too small to be shown, wherein each cam has a θ delay in rotation, the delay θ is shown in formula 6 and 7 in FIG. 7. Wherein w2 can be equal to k*w1, or w2=k*w1, where k=2, 3, 4, etc., the profiles of the cam are different but still follows the rules in FIG. 7 in a certain range of crank angles.

Based on the specific characteristics of the combustion chamber volumes and torque patterns described above, retarded ignition is introduced.

Figure 17:
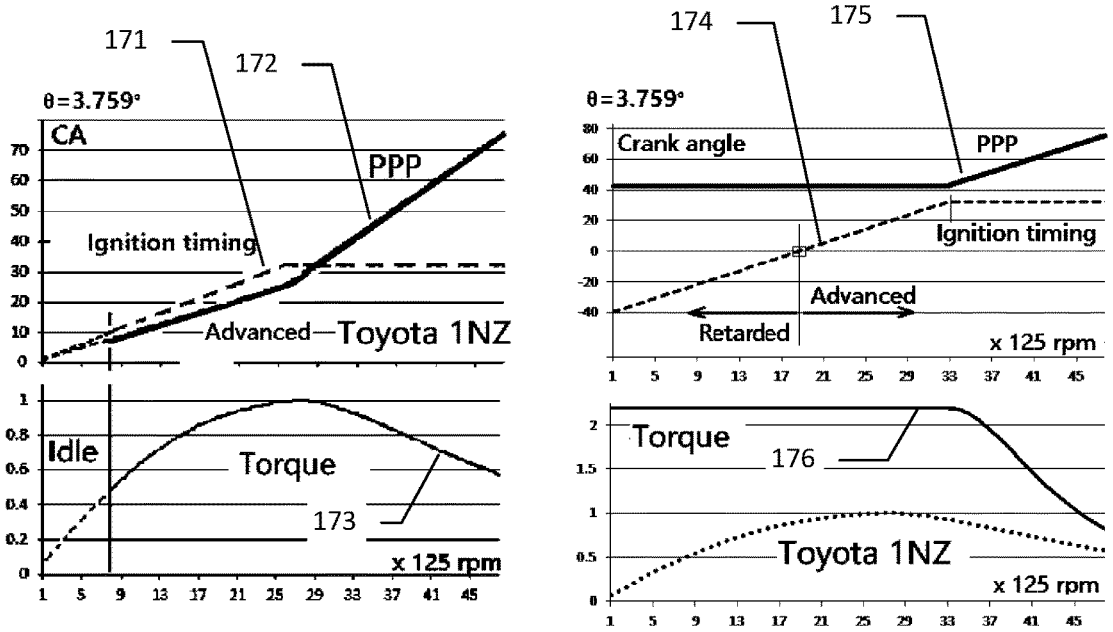
FIG. 17 is a comparison of ignition timings, PPP and output torques between 1NZ and one of the embodiments of the present invention.

FIG. 17 is a comparison of torques, ignition timings and PPP positions between Toyota 1NZ and example A:

ignition timing is 171, combustion PPP is 172, torque on crankshaft is 173 in engine 1NZ.

ignition timing is 174, combustion PPP is 175, torque on crankshaft is 176 in example A.

The ignition timing curves 171 and 174 both have advanced angles before TDC, and only 174 has retarded angles after TDC.

wherein "advanced or (+)" means ignition starts before the main piston reaches its TDC, "retarded or (−)" means ignition starts after (−) the main piston passes its TDC.

Wherein both main pistons are same: L=140.85, L0=12 (mm), R=42.18, Vc=8.916. The auxiliary piston is l1=L/5.20, r1=R/4.88 and k=3 in example A. The main piston and auxiliary piston are expressed as formulas in FIG. 7.

In 1NZ, PPmax=33.256°, as shown in FIG. 11. But only limited peaks of combustions can be located at PPmax. At low speed, it is impossible to make the PPP located at PPmax because the flame delays (fd). Start of each ignition must be before the top dead end of the piston, it is shown as the advanced ignition, and retarded ignition is not practicable in 1NZ. That means most the PPP appear before PPmax=33.256° below 2000 RPM.

Curve 172 is the combustion PPP curve in 1NZ when flame delay is 3.45 ms. At each RPM, there is an ignition timing which makes the output torque most effective. For each combustion, the peak combustion pressure is at its individual PPP. The ignition timing and PPP are shown as 171 and 172, and the result torque is shows as 173. In engine model 1NZ, PPP never coincides with PPmax at speed lower than 1000 RPM.

Curve 172 shows that PPP is located at very low crank angles at 2000 RPM and below, and it is impossible to make effective output torque below idle (<800 RPM) because combustion peak pressure is too close to top dead center and the result torque is very low, this can be as expressed in formula 4 in FIG. 7.

Situation is changed in engine model example A. The PPmax moves from 33.256° CA (1NZ) to 45.761° CA (example A) while the combustion chamber volume keeps nearly constant from θ to 30° CA in example A, this creates an 12.0° CA extra time delay window to compensate to flame delay, or, more specifically, this makes retarded ignition possible, as shown in FIG. 11.

Cure 174 is the ignition timing in example A. For at speed below 2000 RPM, each peak combustion PPP can be located at PPmax exactly by retarded ignition. Full torque can be achieved below 2000 RPM or even at low as at 100 RPM. Curve 176 shows the torque is almost constant from 100 RPM to 2000 RPM; this can never be achieved in 1NZ or traditional piston engines. Curve 176 shows that torque increment is over 300% at <1000 RPM at same fuel combusted.

The applications of the invention are not limited to above examples. For each given piston with specific L, R and Vc, there is a number of auxiliary piston configurations (or auxiliary piston positions/motions) to constrain the combustion chamber volumes to constrain a V≈Vc near TDC. The formulas in FIG. 7 can be used to determine the sizes and positions of the auxiliary motions and positions.

It is to be mentioned that if the θ in formula number 6 is not equal to the θ in formula number 7, more profiles (or trajectories) of the combustion chamber can be achieved, different torque patterns can be obtained.

The PPP and ignition timing readings in FIG. 17 should be plus θ=3.759°. For easy understand and comparison, the vertical grids of PPP and ignition timing readings in FIG. 17 are based on L0=0.

Figure 18:
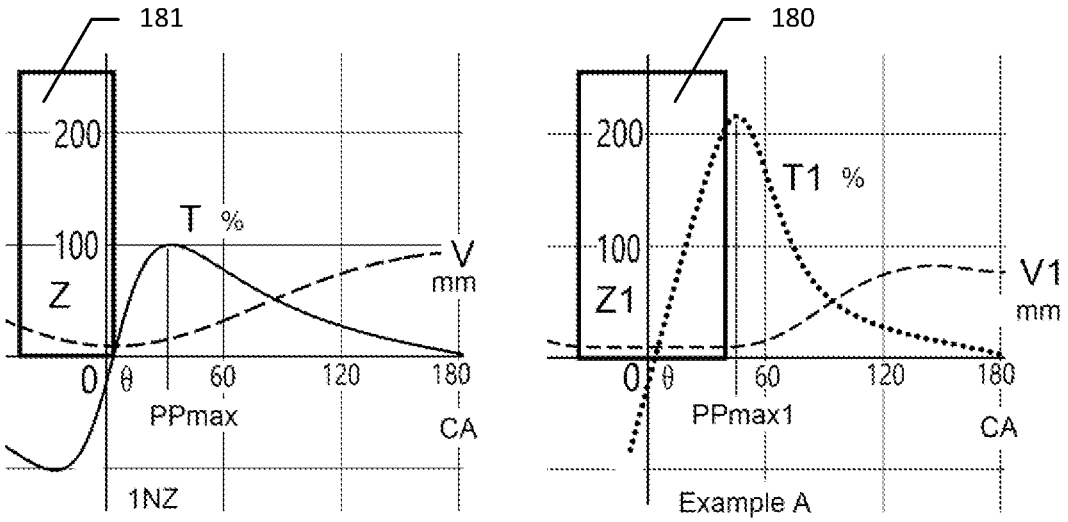
FIG. 18 is a comparison of ignition zones, volumes and output torques between 1NZ and one of the embodiments of the present invention k=3.

More explanation of the ignition in the present invention is explained in FIG. 18. Wherein T, V, Z is the torque, combustion volume and ignition starting zone of 1NZ; and T1, V1, Z1 is the torque, combustion volume and ignition starting zone of example A. The ignition starting zone Z1 180 is extended to near 40° CA in example A, while in 1NZ the ignition starting zone Z 181 never goes bigger than θ. The ignition starting zone 180 is closer to PPmax1 and is more likely to make PPP located at PPmax1 in example C, while the ignition starting zone 181 is farther to PPmax and is more likely to make PPP apart from PPmax in 1NZ. The combustion chamber configuration in the present invention fundamentally re-defines the characteristics of the piston engine we have followed for over one hundred years.

Figure 19:
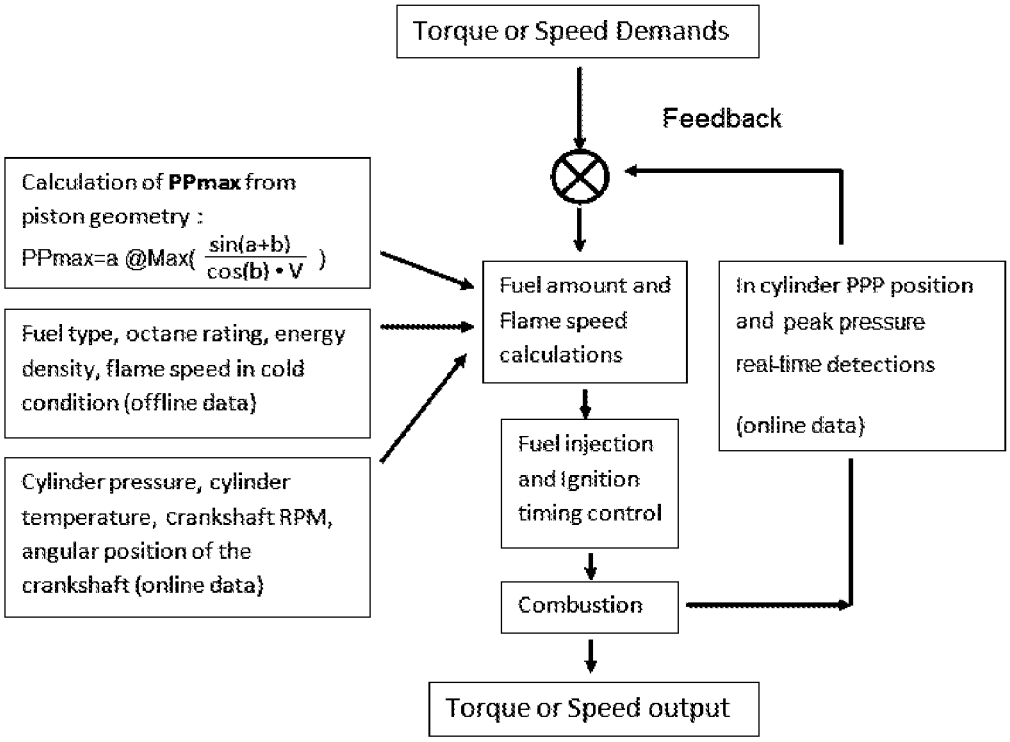
FIG. 19 is an illustration of torque control logic in one of the embodiments of the present invention.

FIG. 19 is one of the torque control method of the present invention, explained in A1 to A5:

A1, the PPmax can be calculated from engine geometry (L, R, Vc and L0 and auxiliary piston motion trajectory).

A2, the initial flame speed and flame delay fd can be calculated from cold condition data (fuel type, piston position/compression ratio, crankshaft speed, etc.).

A3, the fuel amount to be injected can be calculated from torque demand and fuel energy density.

A4, the ignition timing in ° CA is Ai=fd*n*(6/1000)−PPmax.

Wherein fd is flame delay in milli-second at present condition, (as fd in FIG. 3B).

Wherein n is crankshaft rotation speed:

=n (in RPM or rotations per minute)

=n*(6/1000°) CA (DPmS or degrees in per milli-second)

It is to be noticed that Ai is the timing before or after TDC (advanced or retarded). Because in traditional piston engine expressions, "advanced" actually means a minus angle (an angle before TDC; "retarded" actually means a plus angle (an angle after TDC).

In the embodiments of present invention, the actual ignition start position is located at:

a=−Ai (° CA) in crank angle of the main crankshaft.

When Ai>θ, the ignition is advanced, and it starts before a=θ.

When Ai<θ, the ignition is retarded (or delayed), and it starts after a=θ.

Ai is also shown in FIG. 17 for models in 1NZ and example C.

For example, when Ai=12° CA, it is advanced ignition, the ignition starts at minus 12° CA and it is before θ° CA; when Ai=−15° CA, it is retarded ignition, the ignition starts at plus 15° CA and it is after θ° CA, in referring to CA axis in FIGS. 10, 11 and 18.

The ignition timings reading (Ai) should be offset by 0=3.759° in FIG. 17 because there is a 3.759° phase shift in vertical grid in FIG. 17.

A5, the flame speed and ignition timing can be further re-calculated (or compensated) by real-time feedback of actual cylinder pressure and PPP detected by sensors. So that each combustion can be more accurately located as closer as possible to the PPmax position to achieve best torque.

The notorious engine knocking phenomena can be prevented by making fuel ignition after a=θ in spark ignition or in compression ignition or in both.

The notorious engine knocking phenomena can be prevented by making fuel injection after a=θ.

It is important to be mentioned that the auxiliary motion trajectory is not necessarily perfectly follows the formulas 6-9 in FIG. 7 in the range described above. As for as the minimum combustion chamber volume Vc (or clearance volume) keeps constant from θ to a bigger crank angle, and peak pressure of combustion is made after the far (right) end of the Vc, higher output torque can be achieved.

The basic rule in the present invention is to extend Vc from θ to a bigger crank angle X. For the trajectories or shapes of the combustion chamber volume V beyond this "bigger crank angle X", there are no strict restrictions. So the motions of the auxiliary piston configurations can be more flexible. The combustion chamber volumes and the motions of the auxiliary piston can be expressed in a combination of many elements in different frequencies with different amplitudes, according to Fourier Transform Theory, in the present invention, the lower frequency elements play key roles in the functional expression (V shapes or Torques), and the higher frequency element contributes less. As far as the lower frequency elements keep the same, the variations of the results are kept in a certain acceptable range. This is why as far as the combustion chamber volumes are constraint to V=Vc from θ to X, the descriptions basically keep true regardless the variations in V shapes beyond this X. This is specifically claimed in claim 14.

The invention claimed is:

1. A piston engine, comprising:

a cylinder defining an interior space therein, the cylinder encloses a chamber therein, a main piston configured to fit sealingly inside the cylinder and move up and down along the centerline of the cylinder therewithin; an auxiliary piston is configured to fit inside the cylinder and move up and down along the centerline of the cylinder, the main piston is connected to a first connecting rod, the first connecting rod is connected to a first crankshaft, the auxiliary piston is connected to a second connecting rod, the second connecting rod is connected a second crankshaft, wherein the length l of the second connecting rod is shorter than the length L of the first connecting rod; the throw radius r of the second crankshaft is smaller than the throw radius R of the first crankshaft, the motion of the auxiliary piston relates to the rotational motion of the first crankshaft, wherein at any position of the first crankshaft, the auxiliary piston is at a corresponding position; wherein the main piston and the auxiliary piston move at different frequencies, wherein when the centerline of the first connecting rod is at its vertical position, the centerline of the first connecting rod has an offset L0 to the center of the first crankshaft; the offset L0 is bigger than R*10%, wherein a is crank angle of the first crankshaft, wherein the main piston reaches its top dead center at a=θ=arc sin[L0/(L+R)], wherein the side force on the main piston is zero (0) at a=arc sin(L0/R), the enclosed space within the cylinder and between the main piston and the auxiliary piston defines a combustion chamber with volume V, wherein when the first crankshaft is at a=θ position, the auxiliary piston is at a position which constrains the combustion chamber V to its minimum and to equal to Vc, wherein Vc is defined as a clearance volume, the motions of the main piston and the auxiliary piston further constrain the combustion chamber volume V≈Vc from a=θ to a>15° (CA) in referring to the crank angle of the first crankshaft.

2. The piston engine of claim 1, wherein:

the motion frequency of the second crankshaft is 2 times of the motion of frequency of the first crankshaft, the variation of the Vis within 1% of Vc, or (Vc−Vc*1%) <V<(Vc+Vc*1%) from a=θ to a>40° (CA).

3. The piston engine of claim 1, wherein:

the motion frequency of the second crankshaft is 3 times of the motion of frequency of the first crankshaft, the variation of the Vis within 1% of Vc, or (Vc−Vc*1%) <V<(Vc+Vc*1%) from a=θ to a>30° (CA).

4. The piston engine of claim 1, wherein:

the motion frequency of the second crankshaft is 4 times of the motion of frequency of the first crankshaft, the variation of the Vis within 1% of Vc, or (Vc−Vc*1%) <V<(Vc+Vc*1%) from a=θ to a>20° (CA).

5. The piston engine of claim 1, wherein:

the motion frequency of the second crankshaft is 5 times of the motion of frequency of the first crankshaft, the variation of the Vis within 1% of Vc, or (Vc−Vc*1%) <V<(Vc+Vc*1%) from a=θ to a>15° (CA).

6. The piston engine of claim 1, wherein:

the auxiliary piston reaches its bottom dead center when the moment the main piston is at its top dead center.

7. The piston engine of claim 1, wherein:

when at the moment of a=θ=arc sin[L0/(L+R)], the centerline of the first connecting rod is aligned with the centerline of the second connecting rod.

8. The piston engine of claim 1, wherein:

when the main crankshaft speed is below 1000 rpm, the fuel injection is retarded or ignition is retarded to make the start of combustion after position a>θ, and no combustion occurs before position a=θ.

9. A piston engine, comprising:

a cylinder defining an interior space therein, the cylinder encloses a chamber therein, a main piston configured to fit sealingly inside the cylinder and move up and down along the centerline of the cylinder therewithin; an auxiliary piston is configured to fit inside the cylinder and move up and down along the centerline of the cylinder, the main piston is connected to a first connecting rod, the first connecting rod is connected to a first crankshaft, the position of the auxiliary piston is controlled by an actuator mechanism, wherein the length of the first connecting rod is L; the throw radius of the first crankshaft is R, the motion of the auxiliary piston relates to the rotational motion of the first crankshaft, wherein at any position of the first crankshaft, the auxiliary piston is at a corresponding position; wherein the main piston and the auxiliary piston move at different frequencies, wherein when the centerline of the first connecting rod is at its vertical position, the centerline of the first connecting rod has an offset L0 to the center of the first crankshaft; the offset L0 is bigger than R*10%, wherein a is a crank angle of the first crankshaft, wherein the main piston reaches its top dead center at a=θ=arc sin[L0/(L+R)], wherein the side force on the main piston is zero (0) at a=arc sin(L0/R), the enclosed space within the cylinder and between the main piston and the auxiliary piston defines a combustion chamber with volume V, wherein when the first crankshaft is at a=θ position, the auxiliary piston is at a position which constrains the combustion chamber V to its minimum and to equal to Vc, wherein Vc is defined as a clearance volume, the motions of the main piston and the auxiliary piston further constrain the combustion chamber volume V≈Vc from a=θ to a>10° (CA) in referring to the crank angle of the first crankshaft.

10. The piston engine of claim 9, wherein the actuator mechanism is a cam:

the profile of the cam is configured to make the auxiliary piston position P10 follows formula P10=D−[r*cos(a10)+l*cos(b10)] in the range of θ−180° CA to θ+180° CA of the first crankshaft;

a10=k*(a−θ)+180°, b10=arc sin[(r/l)*sin(a10)] k is integer 2, 3, 4 or 5;

D, r and l are constant numbers;

the combustion chamber volume V is constrained to (Vc−Vc*1%)<V<(Vc+Vc*1%) from a=θ to a>15° (CA).

11. The piston engine of claim 9, wherein the actuator mechanism is a cam:

the profile of the cam is configured to make the auxiliary piston position P10 follows formula P10=D−[−r*cos(a10)+l*cos(b10)] in the range of θ−120° CA to θ+120° CA of the first crankshaft;

a10=k*(a−θ)+180°, b10=arc sin[(r/l)*sin(a10)] k is integer 2, 3, 4 or 5;

D, r and l are constant numbers;

the combustion chamber volume V is constrained to (Vc−Vc*1%)<V<(Vc+Vc*1%) from a=θ to a>15° (CA).

12. The piston engine of claim 9, wherein the actuator mechanism is a cam:

the profile of the cam is configured to make the auxiliary piston position P10 follows formula P10=D−[r*cos(a10)+l*cos(b10)] in the range of 0° to θ+120° CA of the first crankshaft;

a10=k*(a−θ)+180°, b10=arc sin[(r/l)*sin(a10)] k is integer 2, 3, 4 or 5;

D, r and l are constant numbers;

the combustion chamber volume Vis constrained to (Vc−Vc*1%)<V<(Vc+Vc*1%) from a=θ to a>15° (CA).

13. The piston engine of claim 9, wherein the actuator mechanism is a servo:

the motion of the servo is configured to make the auxiliary piston position P10 follows formula P10=D−[r*cos(a10)+l*cos(b10)] in the range of 0° to θ+120° CA of the first crankshaft;

a10=k*(a−θ)+180°, b10=arc sin[(r/l)*sin(a10)] k is integer 2, 3, 4 or 5;

D, r and l are constant numbers;

the combustion chamber volume V is constrained to (Vc−Vc*1%)<V<(Vc+Vc*1%) from a=θ to a>15° (CA).

14. The piston engine of claim 9, wherein the actuator mechanism is a camshaft:

the profile of the camshaft is configured to make the auxiliary piston position constraining the minimum combustion volume Vc extended to an main crankshaft angle a>10° CA, or the combustion chamber volume Vis constrained to (Vc−Vc*1%)<V<(Vc+Vc*1%) from a=θ to a>10° (CA).

15. A direct torque control method of a piston engine with crankpin offset, comprising:

a cylinder defining an interior space therein, the cylinder encloses a chamber therein, a main piston configured to fit sealingly inside the cylinder and move up and down along the centerline of the cylinder therewithin; an auxiliary piston is configured to fit inside the cylinder and move up and down along the centerline of the cylinder, wherein the main piston is connected is a main crankshaft via a main connecting rod, wherein angle a is defined as the crank angle of the main crankshaft, angle b is defined as the angle of the centerline of the main connecting rod, the main piston and the auxiliary piston move at different frequencies, the enclosed space within the cylinder and between the main piston and the auxiliary piston defines a combustion chamber with volume V, wherein when the centerline of the main connecting rod is at its vertical position, the centerline of the main connecting rod has an offset L0 to the center of the main crankshaft; wherein θ=arc sin[L0/(L+R)] and L0 is bigger than R*10%, wherein when the main piston is at its top dead center at a=θ, wherein the side force on the main piston is zero (0) at a=arc sin(L0/R), wherein when the main crankshaft is at a=θ position, the auxiliary piston is at a position which constrains the combustion chamber V to its minimum and to equal to Vc, wherein Vc is defined as a clearance volume, the motions of the main piston and the auxiliary piston further constrain the combustion chamber volume V≈Vc from a=θ to a>10° (CA) in referring to the crank angle of the main crankshaft, wherein PPmax is the crankshaft angle a when expression [(l/V)*sin(a+b)/cos(b)] makes its maximum value in the range from θ to 90° (CA), wherein below speed 200 rpm of the main crankshaft, all peaks of combustion pressure are located at PPmax position; wherein below speed 200 rpm ignition starts after θ.

16. The direct torque control method of the piston engine of claim 15, wherein:

ignition timing is calculated by Ai=fd*n*(6/1000)−PPmax, wherein fd is flame delay in milli-second (ms or 1/1000 second), wherein n is rotational speed of the main crankshaft in RPM or rotation per minute, when Ai>θ, it is advanced ignition, ignition starts before θ, when Ai<θ, it is retarded ignition, ignition starts after θ, ignition position is located at a=−Ai (TDC) in referring to the main crankshaft.

17. The direct torque control method of the piston engine of claim 15, wherein:

fuel injection is started after a=θ in speed below 200 rpm, engine knocking can be prevented by making fuel injection after a=θ.

18. The direct torque control method of the piston engine of claim 15, wherein:

ignition is located after a=θ, engine knocking can be prevented by making fuel ignition after a=θ in spark ignition.

19. The direct torque control method of the piston engine of claim 15, wherein:

ignition timing is controlled to make ignition start after a=θ to prevent engine knocking in spark ignition or in compression ignition or in both.

20. The direct torque control method of the piston engine of claim 15, wherein:

the amplitude of the instantaneous torque is directly controlled by the amount of fuel injected in speed below 200 rpm.

* * * * *